US005787745A

United States Patent [19]

Chang

[11] Patent Number: 5,787,745

[45] Date of Patent: Aug. 4, 1998

[54] KEY-CHAIN WITH ANNUAL CALENDAR

[76] Inventor: Kun-sheng Chang, No. 25, Lane 59, Chungcheng Rd., Luchou Hsiang, Taipei Hsien, Taiwan

[21] Appl. No.: 681,218

[22] Filed: Jul. 22, 1996

[51] Int. Cl.[6] ..... A44B 15/00

[52] U.S. Cl. ..... 70/456 R; 70/634; 70/107; 70/109

[58] Field of Search ..... 70/456 R, 457, 70/458, 408; 40/634, 107, 109; D3/208

[56] References Cited

U.S. PATENT DOCUMENTS

| | | | |
|---|---|---|---|
| 497,611 | 5/1893 | Stauffer | 40/107 |
| 2,195,042 | 3/1940 | Wishinsky | 40/634 |
| 2,814,139 | 11/1957 | Clare | 40/109 |
| 4,187,629 | 2/1980 | Yamada | 40/109 |
| 5,033,141 | 7/1991 | Kang | 40/634 |
| 5,294,466 | 3/1994 | Baughman | 40/634 |

*Primary Examiner*—Steven N. Meyers
*Assistant Examiner*—Stephen J. Pentlicki
*Attorney, Agent, or Firm*—Peterson, Wicks, Nemer & Kamrath, P.A.

[57] ABSTRACT

A key-chain with a perpetual calendar constructed in accordance with the present invention includes a body having a central recess, a plate securely mated with the body within the central recess and having at least two substantially "L" shaped openings, a first numbered area provided between the two opposing openings, a second area with numbers of months, a third area with a number of a specific year, and a frame slidably received within the openings with a pair of legs provided on respective sides corresponding to the openings. Furthermore, a specific picture may be inserted into the space between the body and the plate, before the plate is put into the central recess of the body.

1 Claim, 3 Drawing Sheets

KEY-CHAIN WITH ANNUAL CALENDAR

FIELD OF THE INVENTION

The present invention generally relates to a key-chain, and more particularly to a key-chain with a annual calendar attached thereto.

BACKGROUND OF THE INVENTION

This invention has a particular application to a key-chain which has a annual calendar attached thereto.

Prior key-chains each normally have a chain, one end of which is connected to a ring and the other end is connected to certain decoration. This kind of key-chain has only one simple function which is to hold keys and thus is not popular with the public.

Thus, a key-chain with multi-function and constructed in accordance with the present invention tends to mitigate and/or obviate the aforementioned problem.

SUMMARY OF THE INVENTION

The main objective of the invention is to provide a keychain with a annual calendar connected thereto. The annual calendar comprises a body and a plate configured to mate with and be securely connected with the body. The plate has a frame slidably received within at least one slit defined on the plate, such that details of a specific month will therefore be shown within the frame. A picture also may be inserted into the space between the body and the plate, so that the present invention functions not only as a key-chain but also as a annual calendar or a picture holder.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
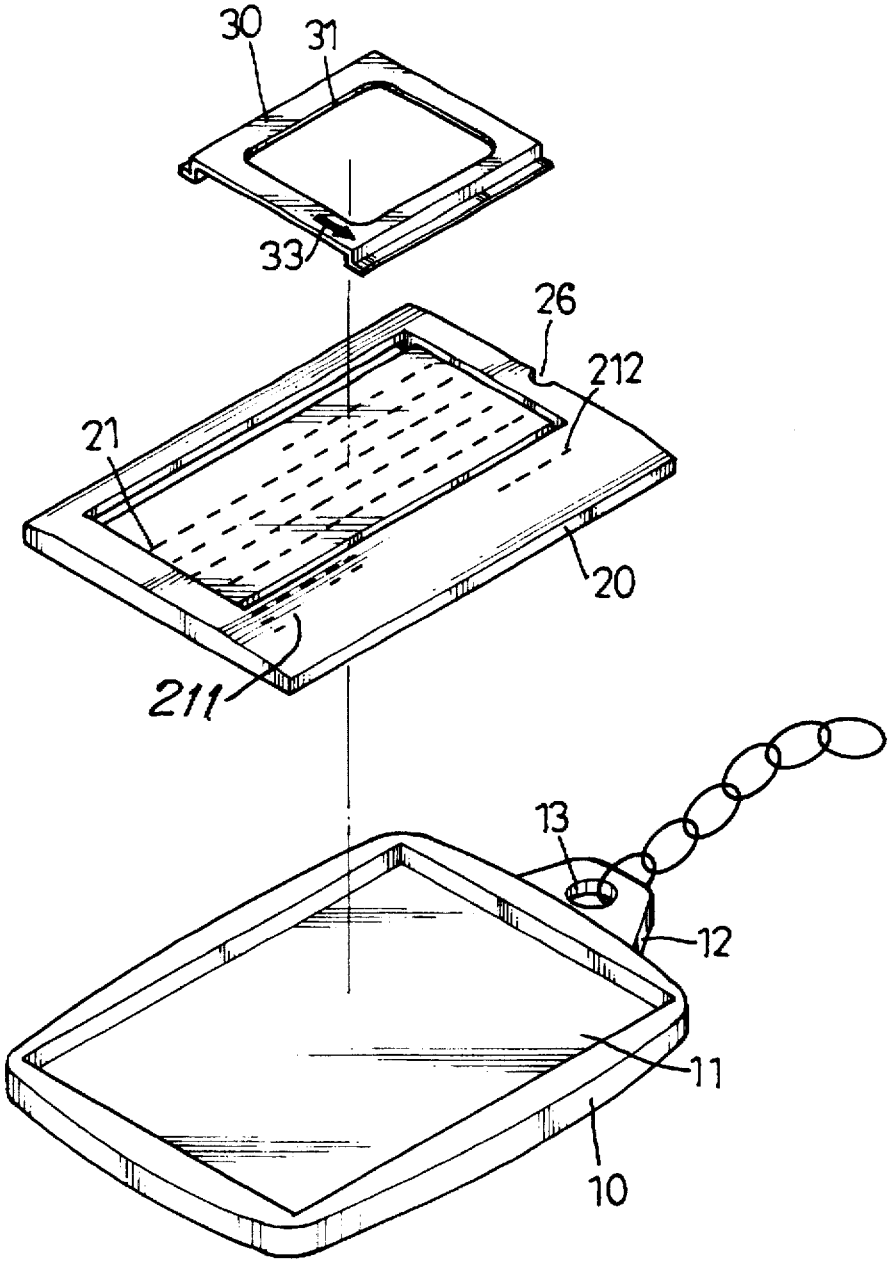
FIG. 1 is an exploded view of one preferred embodiment constructed in accordance with the present invention.

Referring to FIG. 1, one preferred embodiment of the invention is shown. A key-chain constructed in accordance with the present invention comprises a body 10 and a plate 20 situated on the body 10 and having a frame 30 slidably received therein.

Figure 2:
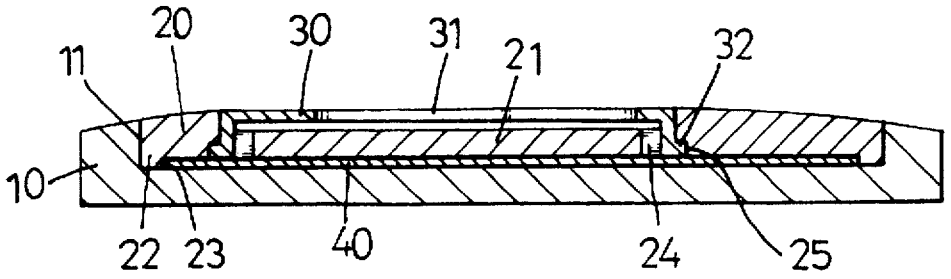
FIG. 2 is a sectional view of the invention.
Figure 3:
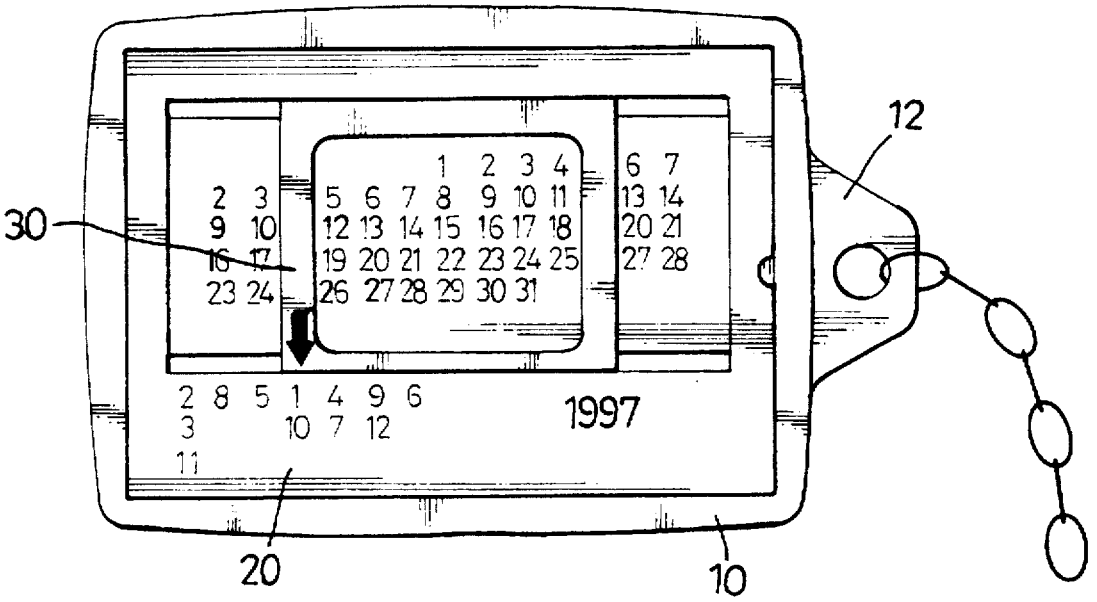
FIG. 3 is a schematic view showing the real operation of the invention.

Referring again to FIGS. 1 and 2, the body 10 may be produced of a transparent material and centrally has a recess 11 for receiving the plate 20 therein. From one preferred embodiment of the invention, such as the one shown in FIG. 2, it is to be noted that after the plate 20 is received within the recess 11 of the body 10, a flush surface is thus formed. The body 10 further has a projection 12 having a hole 13 therein such that a chain (not shown) is able to be securely engaged therewith. Two substantially "L" shaped openings 25 are oppositely defined in the frame 20 and a first area 21 on which numbers are depicted is defined between the two openings 25. Adjacent to one of the openings 25, a second area 211 and a third area 212 respectively depicting a number of months and a year number are provided, and which are spaced apart from each other. The frame 30 is provided with a substantially planar upper portion and two L shaped legs 32 respectively on two sides (not numbered) thereof corresponding to the L-shaped openings 25 and configured to be slidably received within the openings 25.

Figure 4:
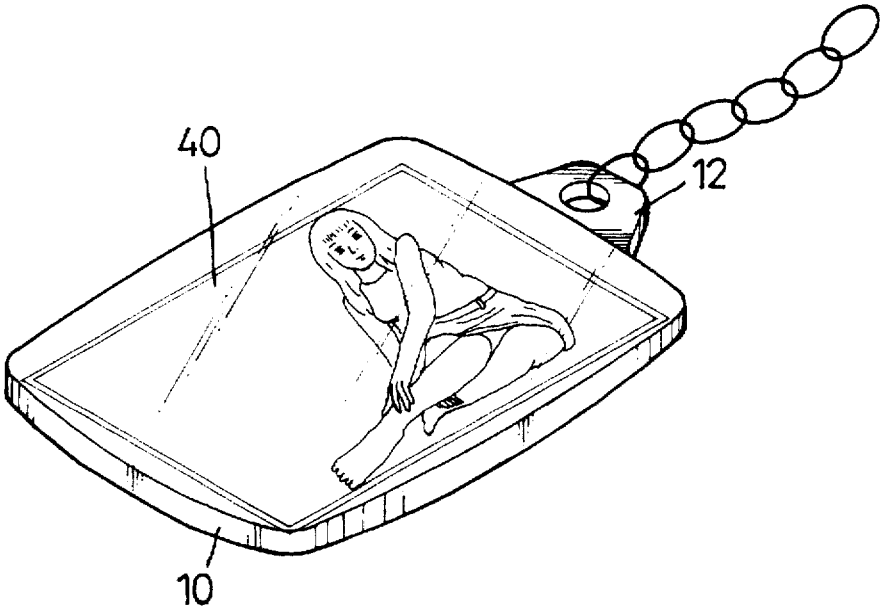
FIG. 4 is still another schematic view of another preferred embodiment.

When the invention is practically used, a user may choose a specific picture and put it within the recess 11 of the body 10, thereafter, the frame 30 is securely held within the recess 11. Due to the material which is used to produce the body 10 being transparent, the image of the picture is clearly shown, as depicted in FIG. 4. Furthermore, with the help of an arrow device 33, every specific number of month is indicated as required by the user when the user slides the frame 30 on the plate 20.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A key-chain with an annual calendar comprising:

a body having a central recess therein;

a plate securely held within said recess and having at least two substantially "L" shaped openings provided therein, a first area provided between said openings, a second area marked with numbers of every month and a third area provided with a number of a specific year, each area being adjacent to said openings and spaced apart from other areas;

a frame having a substantially planar upper portion and depending L-shaped legs provided on both sides corresponding to said openings wherein said frame is slidably received within said openings and having an arrow marked thereon for indicating every number corresponding to the months provided in said second area.

* * * * *